United States Patent [19]

Hostad

[11] 4,191,288

[45] Mar. 4, 1980

[54] SHIPPER DISPLAY UNIT

[75] Inventor: Michael W. Hostad, Romeoville, Ill.

[73] Assignee: Packaging Corporation of America, Evanston, Ill.

[21] Appl. No.: 713,514

[22] Filed: Aug. 11, 1976

[51] Int. Cl.[2] ..... B65D 5/52

[52] U.S. Cl. ..... 206/45.22; 206/44 R; 229/34 R

[58] Field of Search ..... 206/44 R, 44.12, 45.11, 206/45.12, 45.14, 45.2–45.22, 491, 526; 229/16 D, 34 R; 248/174

[56] References Cited

U.S. PATENT DOCUMENTS

| | | | |
|---|---|---|---|
| 3,127,991 | 4/1964 | Burnett | 206/44 R |
| 3,140,797 | 7/1964 | Arneson | 206/173 |
| 3,305,078 | 2/1967 | Ferrera | 206/44 R |
| 3,664,494 | 5/1972 | Mergens | 206/44 R |
| 3,869,077 | 3/1975 | Tuura | 229/16 D |
| 3,918,576 | 11/1975 | Taub | 206/45.14 X |

FOREIGN PATENT DOCUMENTS

| | | | |
|---|---|---|---|
| 474451 | 6/1951 | Canada | 206/45.2 |
| 1049299 | 1/1959 | Fed. Rep. of Germany | 206/45.12 |

*Primary Examiner*—Steven E. Lipman

*Attorney, Agent, or Firm*—Neuman, Williams, Anderson & Olson

[57] ABSTRACT

A shipper display unit is provided having a removable outer protective member in encompassing relation with an inner member in which are disposed a plurality of products arranged in a substantially stacked relation. When the outer member is removed, substantial portions of the accommodated products are exposed for price making or the like without having to be removed from the inner member.

7 Claims, 5 Drawing Figures

FIG. 3
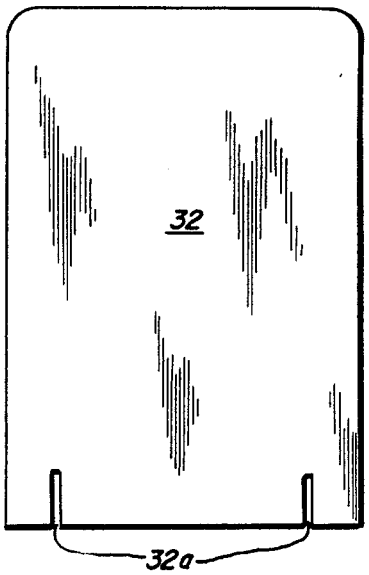
FIG. 5
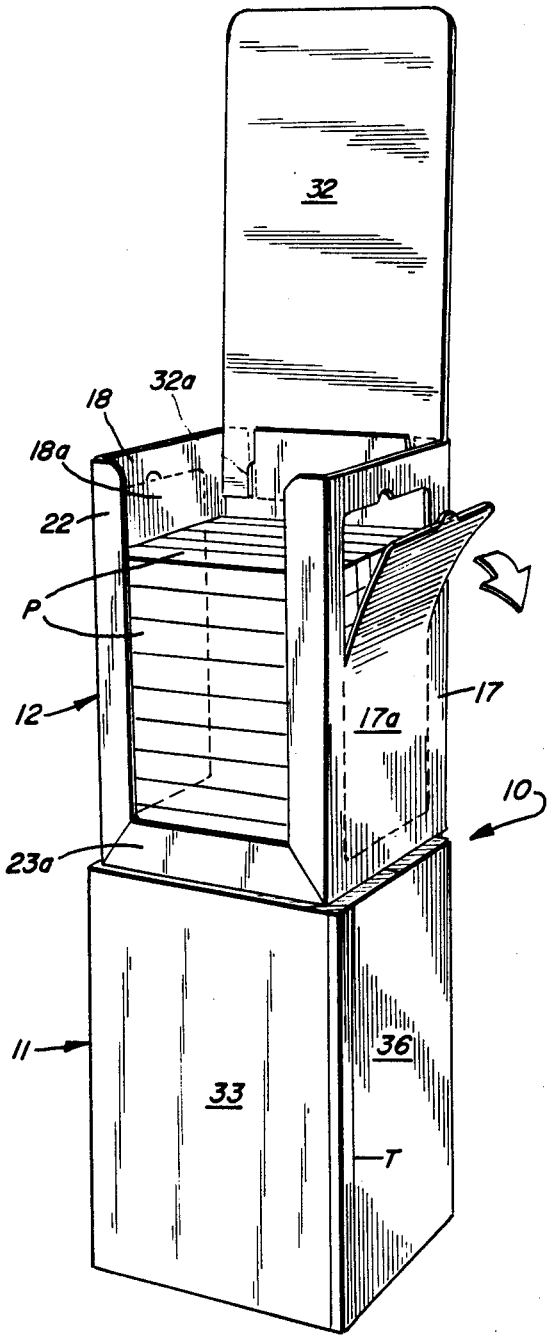
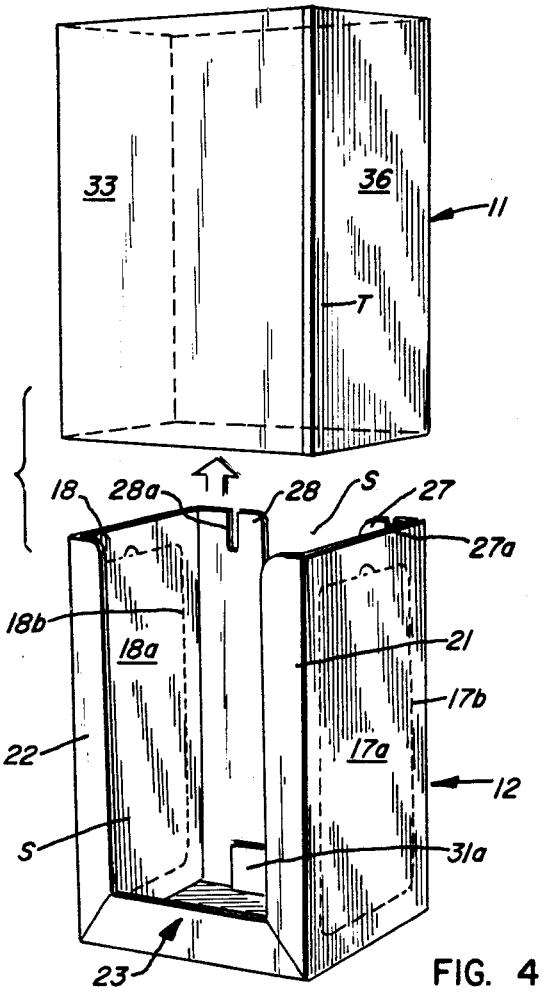
FIG. 4

SHIPPER DISPLAY UNIT

BACKGROUND OF THE INVENTION

In the bulk packaging of a plurality of products for shipment to a retailer or merchandizer, it is a normal practice when the shipment has been received that the container be cut or otherwise mutilated so as to expose portions of the products for purposes of price marking. After the marking has been completed, the products are then removed from the mutilated container and placed for sale on a shelf or counter. In some instances, the products are price marked only when they have been removed from the container. In either instance a substantial amount of physical labor and time is required.

SUMMARY OF THE INVENTION

Thus, it is an object of the invention to provide a shipper display unit wherein, when an outer protective member is removed, the products accommodated within the inner member will have substantial portions thereof exposed for price marking or the like while remaining accommodated within the inner member.

It is a further object of the invention to provide a shipper display unit wherein there is no mutilation of the inner member caused when the accommodated products are being subjected to price marking or the like.

It is a still further object of the invention to provide a shipper display unit wherein the inner and outer members thereof are formed from blanks of inexpensive sheet material which may be readily set up when required.

It is a still further object of the invention to provide a shipper display unit which is of simple, yet sturdy construction, and provides a self-contained attractive, esthetic display for the accommodated products.

Further and additional objects will appear from the description, accompanying drawings and appended claims.

In accordance with one embodiment of the invention, a shipper display unit is provided which is adapted to accommodate a plurality of products arranged in stack relation. The unit includes a removable outer protective member, and an inner member accommodating the products and being encompassed by the outer member. The inner member includes a base panel subtending and engaging the products, a pair of wall panels disposed on opposite sides of the base panel and extending upwardly therefrom, and pairs of flange members foldably connected to the corresponding upright edges of the wall panels. The flange members of each pair are in spaced relation and extend towards one another from the wall panels and are retained in predetermined alignment by foldable means disposed between the wall panels and connected to the periphery of the base panel. When the unit is set up for display purposes, the inner member is placed upon and supported by the outer member.

DESCRIPTION

For a more complete understanding of the invention reference should be made to the drawings wherein:

FIG. 3 is an enlarged plan view of one form of an insert card which may be utilized in combination with the inner member.

FIG. 4 is a perspective view of the inner and outer members set up from the blanks of FIGS. 1 and 2, respectively, but in disassembled relation.

FIG. 5 is a perspective view of the improved shipper display unit set up for display purposes.

Figure 1:
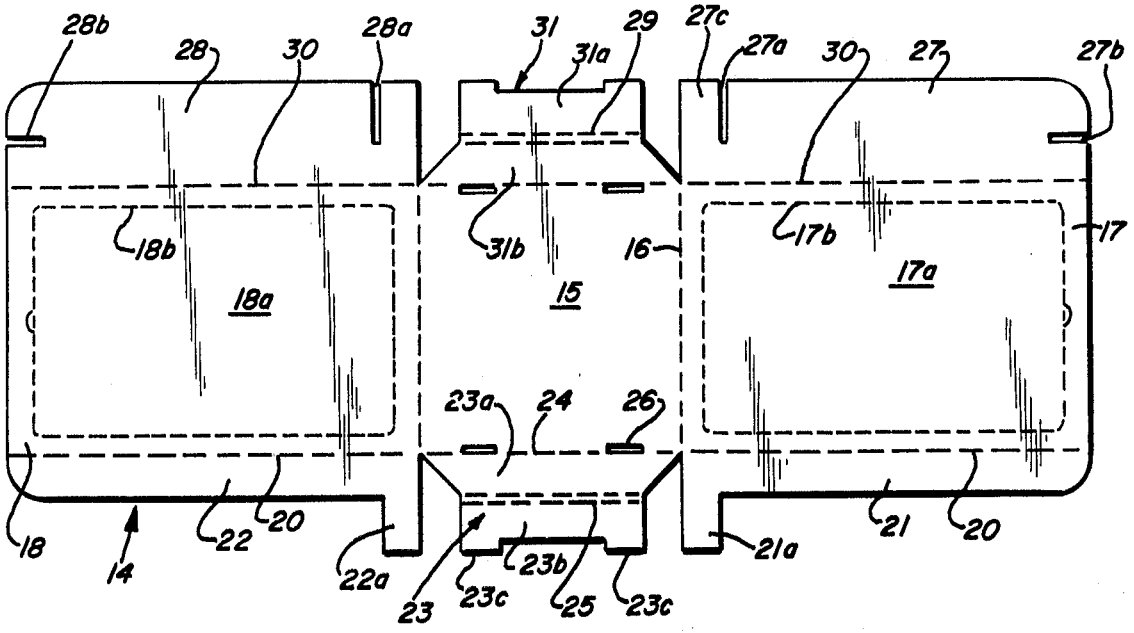
FIG. 1 is a plan view of one form of a blank for the inner member of the improved shipper display unit.
Figure 2:
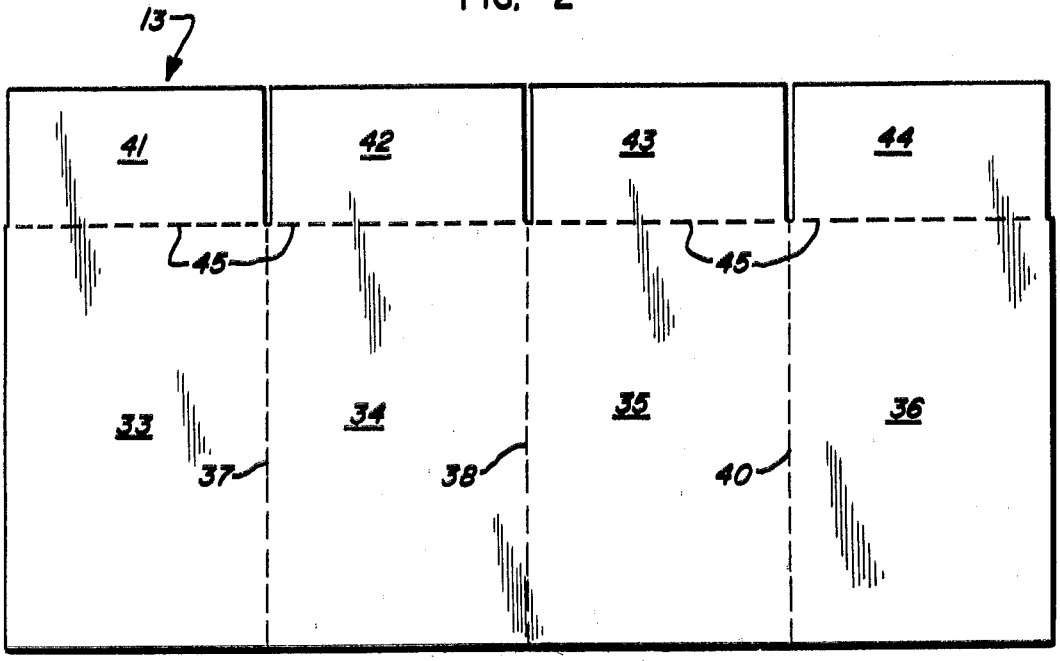
FIG. 2 is a plan view of one form of a blank for the outer member of the improved shipper display unit.

Referring now to the drawings and more particularly to FIG. 5 an improved shipper display unit 10 is shown set up for display purposes. The shipper display unit included an outer protective member 11 and an inner member 12 in which a plurality of products P are arranged in stacked relation. The illustrated outer member 11 is in the form of a conventional half-slotted container, see FIG. 5 which is normally adapted to encompass the inner member after same has been loaded with the products. Member 11 may take other forms, if desired. Members 11 and 12 are preferably formed from blanks 13 and 14, respectively, of suitable fiberboard material.

Blank 14, as seen in FIG. 1, includes a base panel 15, preferably of square or rectangular configuration. Panel 15 subtends and supportingly engages the stacked products as seen in FIG. 5. Disposed on opposite sides of panel 15 and connected thereto by foldlines 16 are wall panels 17, 18, the latter preferably being of like configuration. When blank 14 is set up, the wall panels extend upwardly from the base panel and are disposed in spaced substantially parallel relation, see FIG. 4.

Connected by foldlines 20 to corresponding side edges of wall panels 17, 18 is a first pair of flange members 21, 22. Disposed between flange members 21, 22 is a locking flap 23 which is connected by a foldline 24 to a peripheral segment of base panel 15. Foldlines 20, 24 are disposed in coaxial alignment. Flap 23 is provided with a first section **23*a*, which is adjacent base panel 15, and a second section 23*b*, which is connected by a double foldline 25 to section 23*a*. Foldlines 24, 25 are disposed in spaced parallel relation. Second section 23*b* is provided with a pair of longitudinal spaced locking tabs 23*c* which are adapted to be inserted in and interlock with corresponding apertures 26 formed in base panel 15. The apertures 26 may be located so as to interrupt foldline 24**.

The locking flap 23 is adapted to engage tongue-like portions **21*a*, 22*a* formed on the peripheries of flange members 21, 22 when the blank 14 is set up to form the inner member 12**, as will be described more fully hereinafter.

A second pair of flange members 27, 28 is disposed on the opposite side of wall panels 17, 18, respectively, from flange members 20, 21 and are connected to the wall panels by foldlines 30. A locking flap 31 is provided, which in the illustrated is the same as flap 23, and is disposed between flange members 27, 28.

Flange members 27, 28 are of like configuration and each is provided with a pair of angularly disposed slots **27*a*, 27*b* and 28*a*, 28*b*. Slots 27*a*, 28*a* are spaced from the corresponding ends of the flange members and are disposed substantially perpendicular to foldline 30. Slots 27*a*, 28*a* cooperate with adjacent ends of the flange members so as to form second tongue-like portions 27*c*, 28*c* which interlock with the opposite ends of locking flap 31 when the blank is set up to form the inner member 12**.

Slots **27*b*, 28*b* are provided at opposite ends of the flange members 27, 28 and are adapted to be engaged by a display card or insert piece 32, see FIG. 5, when the shipper display unit is set up for display purposes. Where a display card 32 is not to be utilized, flange members 27, 28 may have the same configuration as flange members 21, 22**.

As seen in FIG. 1, each wall panel 17, 18 is provided with a removable section 17*a*, 18*a*, each of which is substantially delimited by a tear score 17*b*, 18*b*. The function of removable sections 17*a*, 18*a* will be described more fully hereinafter.

As aforementioned, outer member 11 may be in the form of a conventional half-slotted container and is set up from blank 13. Blank 13 includes side panels 33, 34, 35 and 36 which are disposed in side-by-side relation and separated by foldlines 37, 38, and 40, the latter being disposed in spaced parallel relation. Closure flaps 41, 42, 43 and 44 are connected by foldlines 45 to the corresponding edges of the closure flaps. Side panels 33, 36 may be interconnected by a strip of tape T when the blank 13 is set up to form the outer member 11. In order to assure a snug, telescoping fit between the outer and inner members it is important that the side panels of the outer member be closely dimensioned with respect to the corresponding wall panels of the inner member so that, when the inner and outer members are assembled, there will be little or no play between the members which might otherwise deleteriously affect the accommodated products.

Closure flaps 41–44 are secured in overlapping relation so as to form a top or end wall. The inner and outer members may be held in assembled relation by adhesive, tape or any other suitable means.

In setting up the inner members 12, the wall panels 17, 18 are initially folded to upright positions relative to the base panel 15. The flange members are then folded at substantially right angles to the upright wall panels. When so folded the corresponding flange members 21, 22 and 27, 28 at each side will be in spaced, but substantially coplanar, relation. The spacing S between the coplanar flange members is substantial so that when the products are disposed within the inner member, see FIG. 5, substantial exterior portions of the products will be exposed. When the corresponding flange members are in coplanar relation, the tongue-like portions thereof 21*a*, 22*a* and 27*c*, 28*c* will project towards one another. The tongue-like portions are captured between the sections 23*a*, 23*b* and 31*a*, 31*b* of the respective locking flaps 23, 31 when the corresponding sections are folded relative to one another about the double foldlines 25 and 29. Thus, the locking flaps 23, 31 serve to retain the wall panels in proper upright positions, and the corresponding flange members in coplanar relation.

Once the inner member has been set up, as seen in FIG. 4, the products P may be loaded therein in stacked relation through the open top. Once the products are disposed within the inner member 12, the display card 32, see FIG. 3, may be inserted between flange members 21, 22 and the products positioned therebehind. Card 32 is of such dimensions that it will substantially span the distance between the upright wall panels 17, 18 and has a height approximating the height of the wall panels. One edge of the card is provided with a pair of spaced slots 32*a*, see FIG. 3, the purpose of which will be discussed hereinafter.

Once the inner member 12 has been loaded, the set up outer member 11 is slipped endwise over the top of the inner member. In lieu thereof, the blank 13 may be set up in encompassing relation about the loaded inner member. As aforementioned, the outer member is properly sized so as to fit snugly in assembled relation with the inner member. Suitable securing means may be provided for retaining the members in assembled relation while the shipper display unit is being stored or shipped to the customer.

Once the shipper display unit has been received by the customer and is being arranged for merchandising and/or display, the outer member is disassembled endwise from the inner member and used as a supporting stand or pedestal for the inner member, see FIG. 5. The removable sections 17*a*, 18*a* of the wall panels are folded downwardly so as to expose additional exterior portions of the products thereby enabling said additional exterior to be price marked by a stamp or other suitable means without requiring the products to be removed from the inner member. Once the products have been price-marked, the sections 17*a*, 18*a* may be folded back to their upright positions. They will remain in their upright positions because of friction.

The display card 32 is then removed from behind the flange members 21, 22 and placed in a conspicuous upright position at the rear of the inner member. Slots 32*a* of the card 32 interfit with the slots 27*b*, 28*b* of flange members 27, 28 and thus, the card is firmly held in position notwithstanding that the products have been removed from the inner member.

Because of the substantial amount of exposure of the exterior surfaces of the products when they are accommodated within the inner member 12, manual removal of individual products from the inner member is greatly facilitated. Furthermore, exposure of the products enhances their salability. The inner and outer members may be printed with attractive graphics or indicia which will also enhance the esthetic appeal of the shipper display unit. During shipment and handling of the shipper display unit with the inner and outer members in assembled relation, the accommodated products are securely held in place and protected against defacement.

The size and shape of the inner and outer members may vary from that shown without departing from the scope of the invention and will depend upon the type and amount of the products to be packaged therein.

I claim:

1. A shipper display unit for accommodating and retaining therein a plurality of products in a predetermined arrangement, said unit comprising an inner member and an outer member for disposition in either a shipping mode or a display mode without mutilation of said members, said outer member being of tubular configuration and closed at one end; said members, when in a shipping mode, having the outer member in a substantially telescoping, snugly embracing relation with the inner member and concealing the accommodated products, and when in a display mode, having the inner member exposed and subtended and supported by the outer member; said inner member including a base panel, a pair of opposed upright wall panels foldably connected to first peripheral segments of said base panel, and at least one pair of flange members foldably connected to corresponding upright edges of said wall panels and each corresponding pair of flange members extending angularly therefrom towards one another and forming a substantial gap therebetween, one pair of flange members being provided with means for supporting an insert piece when said unit is in a display mode, and means disposed intermediate said wall panels and foldably connected to a second peripheral segment of said base panel and interlockingly engaging said flange members and fixedly retaining same in said gap-forming relation; said base panel, said wall panels, said flange members and the interlocking means therefor coacting to form an open top compartment of fixed dimension for the accommodated products whereby substantial exterior portions of the accommodated products are aligned with the said gap, removal of the accommodated products from the compartment being through the top only when said members are not in said shipping mode.

2. The shipper display unit of claim 1 wherein at least one wall panel has a substantial section thereof selectively movable to expose additional exterior portions of the accommodated products when the members are in the display mode.

3. The shipper display unit of claim 1 wherein said members are formed from blanks of foldable sheet material.

4. The shipper display unit of claim 1 wherein said inner member includes an insert piece spanning the gap formed between the flange members and slidably engaging the surfaces of the the flange members adjacent the compartment, when said unit is in a shipping mode, and being removable therefrom, when in a display mode, the insert piece supporting means of said one pair of flange members being disposed on the periphery of said flange members and being engaged by said insert piece, when said inner and outer members are in a display mode.

5. A blank for use in forming the inner member of a shipper display unit, said blank comprising a base panel which is adapted to subtend and engage a plurality of products disposed in a predetermined arrangement, a pair of wall panels disposed on opposite sides of said base panel and foldably connected thereto, a first pair of flange members disposed on one side of said wall panels and foldably connected to first corresponding edges of said wall panels, a second pair of flange members disposed on the opposite side of said wall panels and foldably connected to second corresponding edges of said wall panels, the folding axes of said flange members being angularly disposed relative to the axes of folding of said wall panels relative to said base panel, the combined widths of each pair of flange members measured perpendicular to the folding axes thereof with the wall panels being substantially less than the distance between the folding axes connecting said wall panels to said base panel, and locking flaps disposed on opposite sides of said base panel and foldably connected thereto, each flap being disposed intermediate the wall panels for interlockingly engaging protruding peripheral portions of a pair of said flange members when said blank is set up to form the inner member, at least one pair of flange members being provided with means for supporting an insert piece, when said blank is set up to form said inner member.

6. The blank of claim 5 wherein at least one of said wall panels has a substantial area thereof defined by a tear score.

7. The blank of claim 5 wherein each locking flap is disposed adjacent to the protruding peripheral portions of a pair of flange members and includes a first section foldably connected to the base panel, and a second section foldably connected to the first section whereby, when the blank is set up, said second section is folded into substantially face-to-face relation with said first section and effects sandwiching therebetween the adjacent protruding peripheral portions of a pair of flange members; said flap second sections having peripheral tabs adapted to engage corresponding apertures formed in marginal segments of the base panel, when said second sections are in substantially face-to-face relation with said first section.

* * * * *